US006002651A

United States Patent [19]

Baccaray

[11] Patent Number: 6,002,651

[45] Date of Patent: Dec. 14, 1999

[54] COMBINATION COMPACT AND WATCH

[76] Inventor: Stella Baccaray, 65 Marc Ct., Westbury, N.Y. 11590

[21] Appl. No.: 09/112,328

[22] Filed: Jul. 9, 1998

[51] Int. Cl.[6] ..... G04B 47/00; G04B 27/00; A45D 42/02

[52] U.S. Cl. ..... 368/10; 368/278; 132/294

[58] Field of Search ..... 368/10, 88, 276, 368/278; 132/293–300

[56] References Cited

U.S. PATENT DOCUMENTS 1,472,350 10/1923 Albanese .
1,823,814 9/1931 Alello .
1,861,644 6/1932 Roberts .
2,473,226 6/1949 Sheldon .
2,601,158 6/1952 MacGillivary .
2,948,106 8/1960 Blumstein .
5,611,362 3/1997 Duncan et al. ..... 132/301

*Primary Examiner*—Vit Miska
*Attorney, Agent, or Firm*—Patent & Trademark Services; Joseph H. McGlynn

[57] ABSTRACT

A container which has a watch in a top compartment and cosmetics in a compartment below the watch. The compartment for cosmetics has a removable tray which contains the cosmetics and an applicator, and has a release aperture which makes it convenient to remove the compartment containing the cosmetics in order to change the cosmetics.

9 Claims, 1 Drawing Sheet

COMBINATION COMPACT AND WATCH

BACKGROUND OF THE INVENTION

This invention relates, in general, to containers for cosmetics, and, in particular, to a container in which the cosmetics are contained in a watch case.

Description of the Prior Art

In the prior art various types of cosmetics containers have been proposed. For example, U.S. Pat. No. 1,472,350 to Albanese discloses a watch case in one end of a container and a powder puff in another end.

U.S. Pat. No. 1,861,644 to Roberts discloses a watch case which has a vanity case beneath the watch.

U.S. Pat. No. 1,823,814 to Aiello discloses a combination watch and compact that is attached to a user's wrist by a strap.

U.S. Pat. No. 2,473,226 to Sheldon discloses a container that is worn on a person's wrist by a wrist band.

U.S. Pat. No. 5,611,362 to Duncan et al discloses a cosmetic container with a latch for holding the cover closed.

SUMMARY OF THE INVENTION

The present invention is directed to a container which has a watch in a top compartment and cosmetics in a compartment below the watch. The compartment for cosmetics has a removable tray which contains two different types or different color of cosmetics and an applicator and has a release aperture which makes it convenient to remove the compartment for cosmetics in order to change the cosmetics.

It is an object of the present invention to provide a new and improved container for cosmetics.

It is an object of the present invention to provide a new and improved container for cosmetics which is concealed within a watch.

It is an object of the present invention to provide a new and improved container for cosmetics which has a release aperture to remove the cosmetics container.

These and other objects and advantages of the present invention will be fully apparent from the following description, when taken in connection with the annexed drawings.

DESCRIPTION OF THE PREFERRED EMBODIMENT

Figure 1:
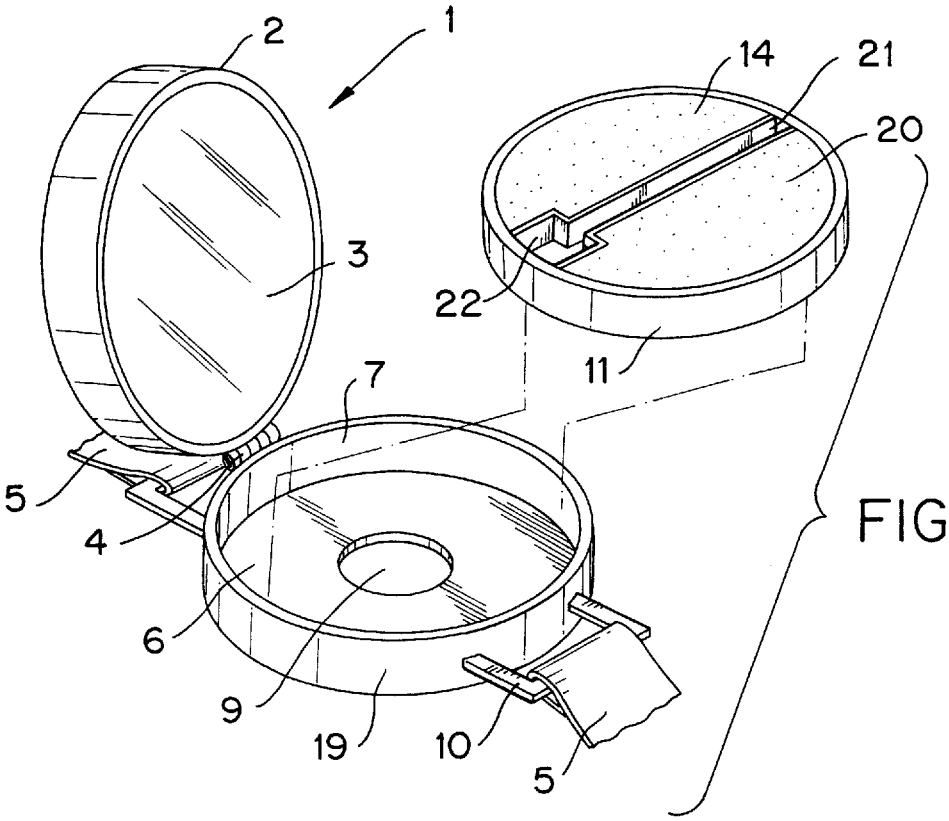
FIG. 1 is an exploded perspective view of the present invention.

Referring now to the drawings in greater detail, FIG. 1 shows an exploded perspective view of the present invention 1. The container of the present invention has a first compartment 2 which is hinged to a second compartment 19 by means of a hinge 4 so that the first compartment 2 can pivot from an open position (shown in FIG. 1) to a closed position (not shown). The first compartment 2 contains a watch mechanism therein with a watch face 8 which will be visible when the compartment 2 is in the closed position. The watch mechanism can be any conventional mechanism such as, but not limited to, an analog or digital mechanism. In addition, a watch band 5, of any conventional type, can be attached to the compartment 19 by brackets 10 so that the present invention can be worn on a person's wrist in a conventional manner. It should be noted that any type of watch band can be used with the present invention without departing from the scope of the invention.

On the inside of the compartment 2 a mirror 3 is attached which can be used to aid in applying cosmetics when the compartment 2 is in the open position. When the compartment 2 is closed the mirror 3 will be hidden and protected from accidental damage.

Positioned within the compartment 19 is a release aperture 9 which extends through the floor 6 of the compartment 19. A removable compartment or container 11 is positioned within compartment 19 so that the outer dimensions of the container 11 will fit snugly against the inner wall 7 of the compartment 19. This snug fit will hold the container 11 firmly within the compartment 19. The container 11 has two sections 14, 20 which will hold two different types or two different colors of the same type of cosmetics such as, but not limited to, lip color or blush contained therein.

A slot 21 separates the cosmetic sections 14, 20, as shown in FIG. 1. The slot is used to store the applicator 15, 16, 17, 18, which is shown in FIGS. 2 and 3.

Figure 2:
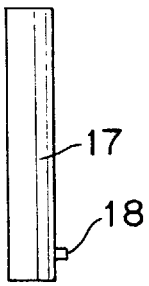
FIG. 2 is a front view of the applicator of the present invention in the closed position.
Figure 3:
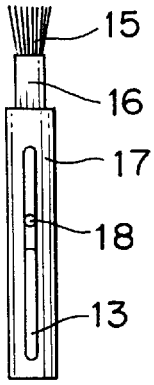
FIG. 3 is a side view of the applicator of the present invention in a partially opened position.
Figure 4:
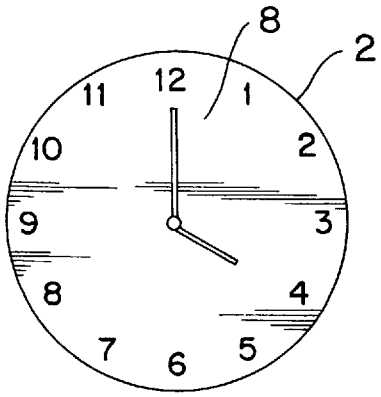
FIG. 4 is a view of the watch of the present invention.

The applicator 15, 16, 17, 18 used with the present invention is a retractable brush and is shown in FIG. 3 in a partially open condition, and in FIG. 2 in a closed condition. The fact that the applicator is retractable will make it more compact and easier to store in the slot 21 of the tray 11, and when it is removed, it can be extended to its full length position and, therefore, easier to use. The applicator shown in FIGS. 2 and 3 is a brush with bristles 15 on one end and at least two relatively retractable sections 16, 17. The relatively retractable sections are of different diameters, as shown in FIG. 3, so one section will be received within an adjacent section when the applicator is collapsed.

Sections 16 has a pin or projection 18 which will engage within a slot 13 formed in section 17. The projection 18 will secure the two sections 16, 17 together and will also act as a lever so the user can move the applicator from the open to the closed position. Also, it should be understood that the preferred cosmetics used with the present invention are lip glosses and the applicator is a brush which will be used to apply the lip glosses. Obviously, other types of cosmetics could be used without departing from the scope of the invention. If other types of cosmetics are used, the applicator selected will be one that can be used to apply the specific cosmetics. However, whichever type of applicator is used it should be retractable for ease of storage and use.

As can be seen in FIG. 1, the slot 21 has an enlarged end 22 which can receive the end of the applicator 15, 16, 17 that has the projection 18 when the applicator is in the closed position. The slot has to be enlarged at 22 in order to accommodate the projection 18 which extends from the side of the applicator.

In order to use the present invention a person would first lift the compartment 2 which will pivot on the hinge 4 to expose the cosmetics and applicator. Next, the applicator 15, 16, 17 will be removed from the slot 21, 22 and extended from the closed position, shown in FIG. 2, to the open or extended position, shown in FIG. 3. The user could then apply the cosmetics using the applicator and the mirror 3, and then return the applicator to the tray 11 when finished and finally close the compartment 2 which will hide the cosmetics tray 11.

When the cosmetics are used up, or if the user wants to switch to a different cosmetic, they would open the compartment 2, and insert a finger or some other object into the aperture 9 from the bottom of the compartment 19. This will "pop" or press the tray 11 at least partially out of the compartment 19 and will make it easier for the user to remove the tray and replace it. Since the tray 11 fits into the compartment 19 with a friction fit, it would be difficult to remove and replace the tray without the release aperture 9.

Although the Watchamacallips and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A combination watch and cosmetics case comprising:

a first compartment having a watch mechanism therein, a second compartment, said second compartment being connected to said first compartment, said second compartment being movable with respect to said first compartment from a closed to an open position, a third compartment being removably connected to said second compartment, said third compartment being divided into at least two sections, each of said sections adapted to hold cosmetics, said at least two sections being separated by a slot, said slot containing an applicator, means for securing said applicator in said slot, and means for ejecting said third compartment from said second compartment.

2. The combination watch and cosmetics case as claimed in claim 1, wherein said third compartment is secured to said second compartment by a friction fit.

3. The combination watch and cosmetics case as claimed in claim 1, wherein said second compartment is connected to said first compartment by a hinge.

4. The combination watch and cosmetics case as claimed in claim 1, wherein said means for ejecting said third compartment from said second compartment is an aperture extending through a floor of said second compartment.

5. The combination watch and cosmetics case as claimed in claim 1, wherein said applicator comprises at least two sections which retract with respect to each other.

6. The combination watch and cosmetics case as claimed in claim 1, wherein said applicator has a brush on one end.

7. The combination watch and cosmetics case as claimed in claim 1, wherein said slot in said third compartment has an enlarged portion at one end.

8. The combination watch and cosmetics case as claimed in claim 5, wherein one of said at least two sections has a projection extending therefrom, and another of said at least two sections has a slot which receives said projection.

9. The combination watch and cosmetics case as claimed in claim 8, wherein said slot in said third compartment has an enlarged portion at one end, and said projection fits into said enlarged portion when said applicator is positioned within said slot.

* * * * *